US009589487B1

(12) United States Patent
Kasler et al.

(10) Patent No.: US 9,589,487 B1
(45) Date of Patent: Mar. 7, 2017

(54) COMBINED EDGELIT SIGNAGE AND ILLUMINATION

(71) Applicant: Cooper Technologies Company, Houston, TX (US)

(72) Inventors: Kraig Kasler, Fayetteville, GA (US); Westly Davis Hetrick, Atlanta, GA (US); Scott Formel, Peachtree City, GA (US); Dylan Isaac James, Smyrna, GA (US); Reed Alan Bradford, Peachtree City, GA (US); Scott David Wegner, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/979,167

(22) Filed: Dec. 22, 2015

Related U.S. Application Data

(60) Provisional application No. 62/095,353, filed on Dec. 22, 2014.

(51) Int. Cl.
*G09F 13/18* (2006.01)
*G09F 13/22* (2006.01)

(52) U.S. Cl.
CPC ..... *G09F 13/18* (2013.01); *G09F 13/22* (2013.01); *G09F 2013/222* (2013.01)

(58) Field of Classification Search
CPC ..... G09F 13/18; G09F 2013/1831; G09F 2013/184; G09F 2013/222
See application file for complete search history.

(56) References Cited

U.S. PATENT DOCUMENTS 3,591,941 A * 7/1971 Jaffe, Jr. ..... F21V 23/00 40/546
4,435,743 A * 3/1984 Plumly ..... G02B 6/0083 362/184
5,276,591 A * 1/1994 Hegarty ..... G02B 6/0036 362/2
5,640,792 A * 6/1997 Smith ..... G02B 6/0003 362/293
6,294,983 B1 * 9/2001 Lee ..... G02B 6/0068 340/332
6,471,388 B1 * 10/2002 Marsh ..... G02B 6/0031 313/318.11
7,246,932 B2 * 7/2007 Burtsev ..... G02B 6/0001 362/23.16
2010/0107462 A1 * 5/2010 Lee ..... G08B 7/062 40/546

(Continued)

*Primary Examiner* — Gary Hoge
(74) *Attorney, Agent, or Firm* — King & Spalding LLP

(57) ABSTRACT

A system can combine edgelit signage and edgelit illumination. The system can comprise two edgelit lightguide sections, one supporting signage and another supporting illumination. The lightguide section that supports signage can comprise a backlit face inscribed with text or graphics conveying an emergency message. The lightguide section that supports illumination can comprise a face patterned with features that release light, for example for emergency illumination. The two lightguide sections can be two areas of a single edgelit lightguide. The two lightguide sections can alternatively formed from two separate lightguides. In some examples, one or more illumination lightguide sections can be configured as a trim plate.

11 Claims, 4 Drawing Sheets

(56) References Cited

U.S. PATENT DOCUMENTS

| | | | | |
|---|---|---|---|---|
| 2011/0047840 | A1* | 3/2011 | Ou | G02B 6/006<br>40/546 |
| 2012/0051053 | A1* | 3/2012 | Cai | G09F 13/18<br>362/249.02 |
| 2012/0124873 | A1* | 5/2012 | Lee | G09F 13/18<br>40/546 |

* cited by examiner

COMBINED EDGELIT SIGNAGE AND ILLUMINATION

CROSS REFERENCE TO RELATED APPLICATIONS

This application claims priority to U.S. Provisional Patent Application No. 62/095,353 filed Dec. 22, 2014 in the name of Kraig Kasler, Westly Davis Hetrick, Scott Formel, Dylan Isaac James, Reed Bradford, and Scott David Wegner and entitled "Combined Edgelit Signage and Illumination," the entire contents of which are hereby incorporated herein by reference.

TECHNICAL FIELD

Embodiments of the technology relate generally to systems that include panel-shaped lightguides, and more particularly to a system in which edgelit signage is combined with edgelit illumination.

BACKGROUND

As compared to incandescent and fluorescent light sources, light emitting diodes (LEDs) offer substantial potential benefit associated with their energy efficiency, light quality, and compact size. However, to realize the full potential benefits offered by light emitting diodes, new technologies are needed.

For instance, there are needs in the art for technology to utilize light emitting diodes for illumination and for backlighting signage. Need further exists for light-emitting-diode-based systems that can provide illumination and signage. Need further exists for light-emitting-diode-based systems that can provide emergency illumination and emergency signage. A capability addressing one or more such needs, or some other related deficiency in the art, would support improved illumination and/or improved signage, and more widespread utilization of light emitting diodes.

SUMMARY

A system can comprise two edgelit lightguide sections. One lightguide section can provide signage, for example comprising a backlit face inscribed with text or graphics conveying an emergency message. A second lightguide section can provide lighting, for example comprising a face that is patterned with features that release light for emergency illumination. The two lightguide sections can be two areas of one edgelit lightguide. Alternatively, the two lightguide sections can be formed from two separate lightguides. In some embodiments, the illumination lightguide section (or sections) can be configured as a trim plate for the system.

The foregoing discussion is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

BRIEF DESCRIPTION OF THE FIGS

Reference will be made below to the accompanying drawings.

Figure 1:
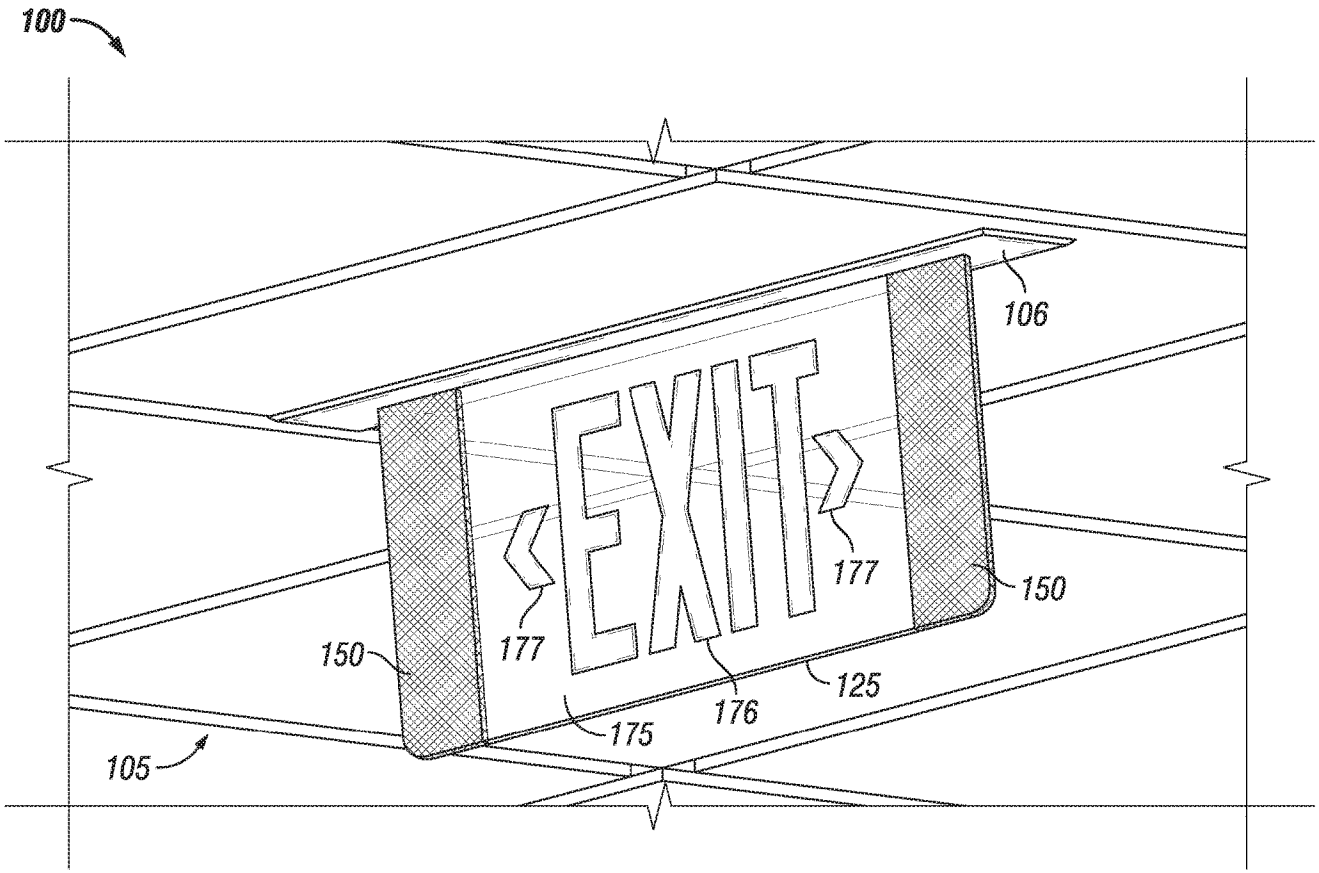
FIG. 1 is an illustration of an example system that combines lighting and signage in accordance with some embodiments of the disclosure.

The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating principles of the embodiments. Additionally, certain dimensions or positionings may be exaggerated to help visually convey certain principles. In the drawings, similar reference numerals among different figures designate like or corresponding, but not necessarily identical, elements.

DETAILED DESCRIPTION OF EXAMPLE EMBODIMENTS

A system can incorporate two lightguide portions, one portion distributing illumination to an area that may be occupied by people, the other portion presenting a message that such people may receive. In some example embodiments, the illumination may comprise emergency lighting, and the message may convey information relevant to an emergency. The two lightguide portions may be two areas of a single lightguide or two separate lightguides, for example.

Some representative embodiments will be described more fully hereinafter with example reference to the accompanying drawings that illustrate embodiments of the technology. The technology may, however, be embodied in many different forms and should not be construed as limited to the embodiments set forth herein; rather, these embodiments are provided so that this disclosure will be thorough and complete, and will fully convey the scope of the technology to those appropriately skilled in the art.

Referring now to FIG. 1, this figure illustrates a combined signage and lighting system 100 according to some example embodiments of the disclosure. As illustrated, the combined signage and lighting system 100 is mounted at a ceiling 105, which may be a suspended ceiling, a non-suspended ceiling, or other appropriate overhead structure. In some embodiments, the combined signage and lighting system 100 is configured for mounting to a wall or other horizontal structure. In various embodiments, the combined signage and lighting system can be configured for indoor deployment, for outdoor deployment, or for both indoor and outdoor applications.

The illustrated combined signage and lighting system 100 comprises an edgelit lightguide 125 that extends from a horizontal plate 106 of the system 100. The edgelit lightguide 125 that conveys a message (in this example indicating exit direction) and that emits illumination. A signage section 175 of the edgelit lightguide 125 is inscribed with text 176 (the word "EXIT" in the illustrated example) and graphics 177 (arrows in the illustrated example). Text 176 and graphics 177 can be viewed as example embodiments of inscriptions. Two illumination sections 150 emit light so that people in an emergency situation can navigate to the indicated exit or exits. The two illumination sections 150 can be viewed as comprising an example embodiment of a luminaire, for example.

Accordingly, the combined signage and lighting system 100 illustrated in FIG. 1 can provide emergency lighting and emergency signage from a single edgelit lightguide 125. As further discussed below, light coupled into the edgelit lightguide 125 from one or more light sources can provide emergency illumination and backlighting for emergency signage, for example.

Figure 2A:
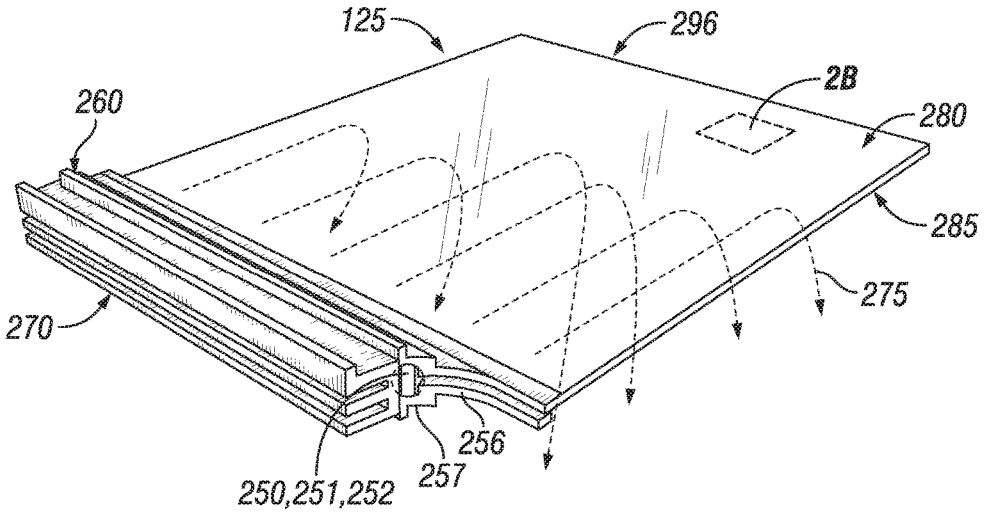
FIGS. 2A and 2B (collectively FIG. 2) is an illustration of an example edgelit lightguide that may be incorporated in the system illustrated in FIG. 1 in accordance with some embodiments of the disclosure.

Referring now to FIG. 2, this figure illustrates an example embodiment of the edgelit lightguide 125 according to some example embodiments of the disclosure. As illustrated, a light source 250 couples light into an edge 256 of the edgelit lightguide 125. In an example embodiment, the light source 250 comprises an array of light emitting diodes (LEDs) 251 that emit light through the edge 256 of the edgelit lightguide 125. Thus, a row of the light emitting diodes 251 can couple light into the edgelit lightguide 125 via the edge 256.

A member 260 extends along the edge 256 of the edgelit lightguide 125 and may be attached to the edgelit lightguide 125 via friction, force fit, clamp, fasteners, bonding agent, or other appropriate attachment means. In the illustrated embodiment, the member 260 can be characterized as a channel and may be formed of metal or other appropriate material or materials.

The illustrated member 260 provides a cavity 257 that extends lengthwise along the edge 256 of the edgelit lightguide 125. As illustrated, the light source 250 comprises a circuit board 252 that is disposed lengthwise in the cavity 257. The light emitting diodes 257 are mounted to the circuit board 252, facing the edge 256 of the edgelit lightguide 125, in an orientation to emit light that is incident upon and passes through the edge 256.

As illustrated, the member 260 comprises grooves or fins 270 that function as or comprise a heat sink for thermal management of the light emitting diodes 251. Thus, the fins 270 help dissipate heat generated by the light source 250 in connection with converting electrical energy into light. To facilitate heat transfer, the member 260 can comprise aluminum or other metal or a thermally conductive plastic material, for example.

In addition to thermal management and to providing a supporting structure for aligning the light emitting diodes 251 to the edge 256 of the edgelit lightguide 125, the illustrated member 260 can provide mechanical support for mounting the edgelit lightguide 125 in the combined signage and lighting system 100. For example, the member 125 can be fastened to the plate 106 utilizing screws or other appropriate fasteners or attachment means. The plate 106 can comprise a slot through which the edgelit lightguide 125 extends, for example with the member 260 located on an upper side of the plate 106.

The major faces 280, 285 of the edgelit lightguide 125 guide the coupled light via internal reflection. In the illustrated embodiment of FIG. 2, the edgelit lightguide 125 has a panel or slab shape with two opposing edges 256, 296. The light emitting diodes 251 introduce light into the edgelit lightguide 125 from the edge 256. The major faces 280, 285 of the edgelit lightguide 125 internally reflect and guide the light towards the opposing edge 296. A portion of the internally propagating light that is incident on one or both of the faces 280, 285 can exit the edgelit lightguide 125 through the faces 280, 285 to achieve gradual light distribution.

In the illustrated embodiment, the edgelit lightguide 125 is generally rectangular. Other example lightguide embodiments may have a triangular, octagonal, oval, circular, polygon, or other appropriate geometric form. The edgelit lightguide 125 can be made by cutting or molding a plate, slab, or panel of optical material and polishing the edges 256, 296 to an optical finish, for example.

Figure 2B:
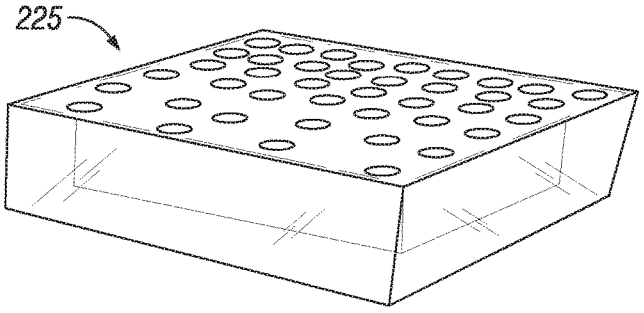

As shown in the detail inset of the illustrated embodiment of FIG. 2B, one of the faces 285 of the edgelit lightguide 125 is patterned with micro-optical features 225 that extract the incident light and provide directional control. Thus, the micro-optical features 225 can help release light in a controlled fashion with directional bias. In some embodiments, both faces 280, 285 are so patterned rather than a single face 285 as illustrated.

The resulting emitting light 275 can be biased down towards a floor or laterally so that the illumination pattern may be beneficially directed for occupant visibility. In various embodiments, the micro-optical features 225 can comprise microlenses, conical features, truncated cones, convex shapes, holes, concave structures, dimples, or other appropriate features, for example. In some example embodiments, the edgelit lightguide 125 comprises one or more of the technologies disclosed in U.S. Pat. No. 8,459,858, the entire contents of which are hereby incorporated herein by reference. In some example embodiments, the edgelit lightguide 125 comprises one or more of the technologies disclosed in U.S. Pat. No. 7,357,553, the entire contents of which are hereby incorporated herein by reference.

In some embodiments, the light emitting diodes 251 of the light source 250 are addressable individually or in banks. In other words, the light emitting diodes 251 can be controlled individually or in groups to emit light. For example, during normal operation, the light emitting diodes 251 over the signage section 175 can emit light continuously, while the light emitting diodes 251 over the illumination sections 150 can be turned off or operated in a dimmed mode. When an emergency situation occurs, all of the light emitting diodes 251 can be controlled to emit maximum light, resulting in emission of sufficient illumination to help occupants navigate to an exit, for example.

Figure 3:
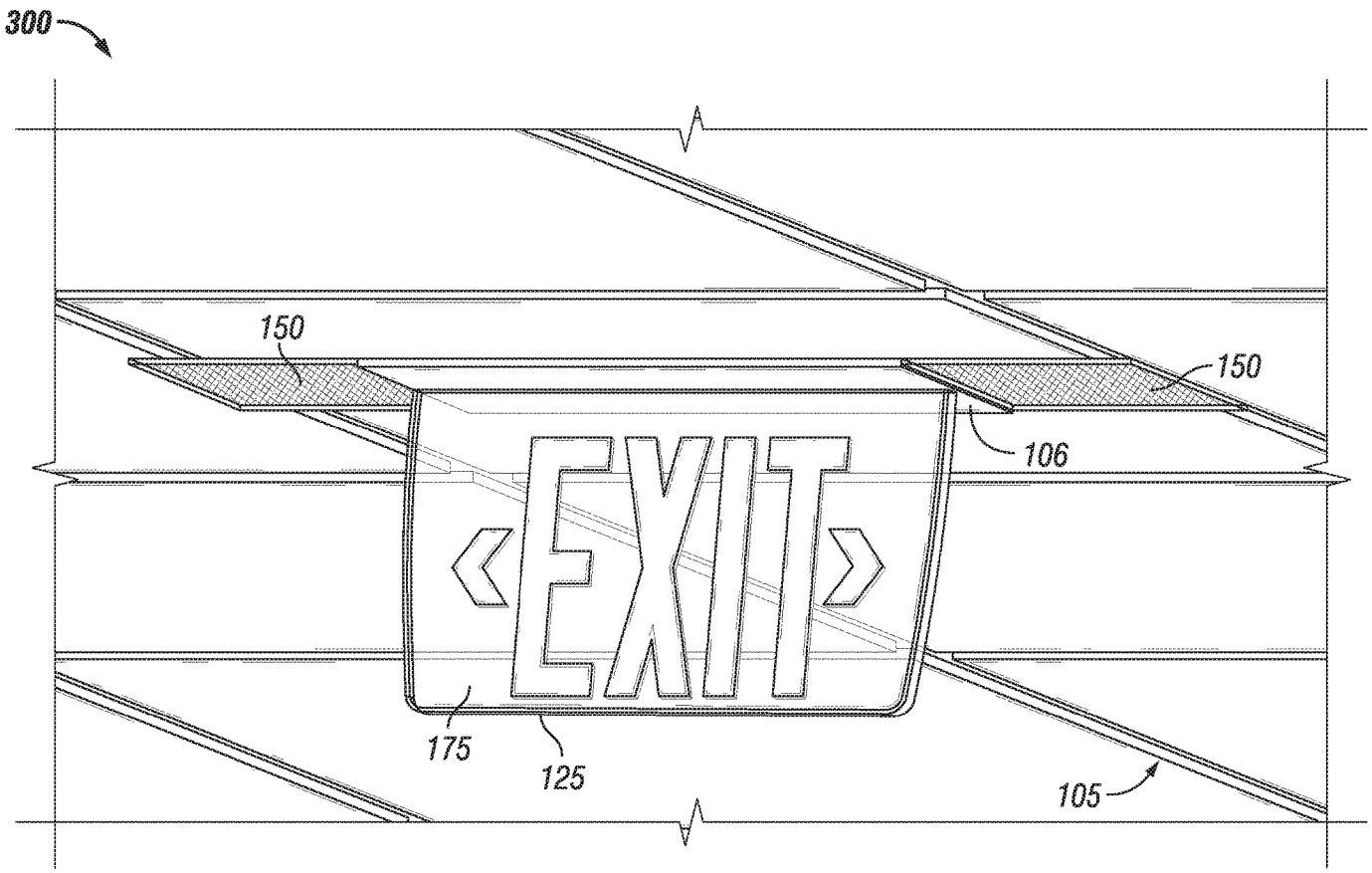
FIG. 3 is an illustration of another example system that combines lighting and signage in accordance with some embodiments of the disclosure.

Turning now to FIG. 3, this figure illustrates another combined signage and lighting system 300 according to some example embodiments of the disclosure. As illustrated, the combined signage and lighting system 300 is mounted at a ceiling 105. In some other embodiments, the combined signage and lighting system 300 can be mounted to a wall or other structure that may be indoors or outdoors, for example.

In the illustrated embodiment of FIG. 3, the combined signage and lighting system 300 comprises three edgelit lightguide sections 150, 175. The signage section 175 is vertically oriented and extends below the plate 106. Meanwhile, the two illumination sections 150 are horizontally oriented and disposed on opposing sides of the plate 106. As illustrated, the horizontal illumination sections 150 are substantially flush with the ceiling 105 or may be recessed, or may protrude into the room.

In an example embodiment, each lightguide section 150, 175 has a dedicated light source 250. Thus, two groups of light emitting diodes 251 (see FIG. 2) can emit light into two respective edges 256, 296 of the illumination sections 150 of lightguide. A third group of light emitting diodes 251 can emit light into the upper edge 256 of the signage section 170 of the edgelit lightguide 125 for backlighting the exit message and associated graphics as discussed above.

The light emitting diodes 251 for the illumination sections 150 can be operated in a dimmed mode or turned off until an emergency occurs. In an emergency, those light emitting diodes can be turned on or brightened so that the illumination sections 150 provide emergency lighting.

Figure 4B:
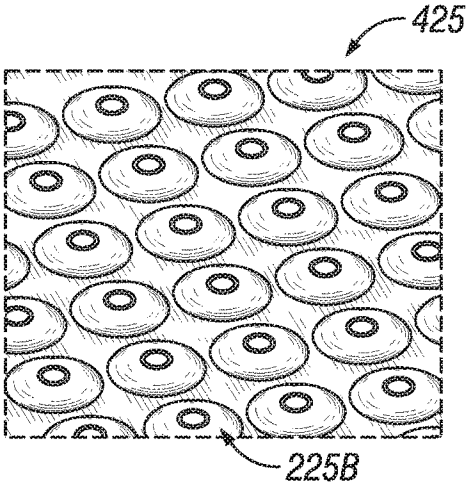
FIGS. 4A and 4B (collectively FIG. 4) is an illustration of another example system that combines lighting and signage in accordance with some embodiments of the disclosure.
Figure 4A:
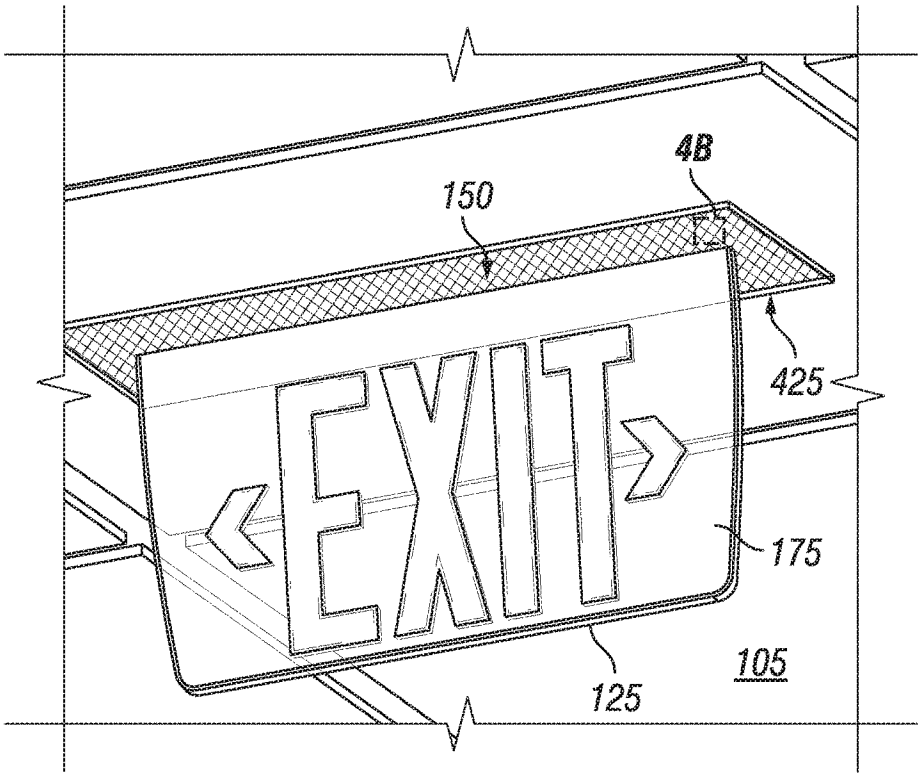

Turning now to FIG. 4, this figure illustrates another combined signage and lighting system 400 according to some example embodiments of the disclosure. As illustrated, the combined signage and lighting system 400 is mounted at a ceiling 105. In various other embodiments, the combined signage and lighting system 400 can be mounted to other appropriate indoor or outdoor structures or surfaces, for example.

In the illustrated embodiment of FIG. 4, the combined signage and lighting system 400 comprises two edgelit lightguide sections 150, 175. The illumination section 150 is horizontally oriented. The signage section 175 is vertically oriented and extends downward from the illumination section 150. In some embodiments, the signage section 175 can extend through a slot in the illumination section 150. The horizontal illumination section 150 can be substantially flush with the ceiling 105, or may be recessed, or may protrude from the ceiling 105.

As shown in the detail inset of the illustrated embodiment of FIG. 4B, the lower face of the illumination section 150 of edgelit lightguide 425 is patterned with micro-optical features 225B that help release light in a controlled fashion as discussed above. In various embodiments, the micro-optical features 225B can comprise microlenses, conical features, truncated cones, convex shapes, holes, concave structures, dimples, or other appropriate features, for example.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A system comprising:

a first plurality of light emitting diodes;

a first lightguide comprising:

a first face;

a second face opposite the first face; and a first edge that extends between the first face and the second face and that is disposed adjacent the first plurality of light emitting diodes so that light emitted by the first plurality of light emitting diodes couples into the first lightguide and propagates between the first face and the second face;

a second plurality of light emitting diodes; and a second lightguide comprising:

a third face;

a fourth face opposite the third face; and a second edge that extends between the third face and the fourth face and that is disposed adjacent the second plurality of light emitting diodes so that light emitted by the second plurality of light emitting diodes couples into the second lightguide and propagates between the third face and the fourth face, wherein at least one of the first face and the second face comprises a backlit inscription, and wherein at least one of the third face and the four face is patterned with optical features for controlled release of the light propagating between the third face and the fourth face, wherein the first lightguide is mounted to a frame in a substantially vertical orientation, and wherein the second lightguide is mounted to the frame in a substantially horizontal orientation.

2. The system of claim 1, wherein the first lightguide and the second lightguide are mounted substantially perpendicular to one another.

3. The system of claim 1, wherein the first lightguide comprises an exit sign, and wherein the second lightguide comprises a luminaire.

4. The system of claim 1, wherein the inscription comprises text.

5. The system of claim 1, wherein the inscription comprises a graphic.

6. The system of claim 1, wherein the inscription denotes an exit.

7. A system comprising:

a frame;

a first edgelit lightguide that is mounted to the frame and that comprises emergency signage; and a second edgelit lightguide that is mounted to the frame and that comprises a luminaire, wherein the first edgelit lightguide is mounted to the frame in a vertical orientation, and wherein the second edgelit lightguide is mounted to the frame in a horizontal orientation above the first edgelit lightguide.

8. The system of claim 7, wherein the first edgelit lightguide comprises a first panel of optical material and the second edgelit lightguide comprises a second panel of optical material.

9. The system of claim 7, wherein the second edgelit lightguide extends in two dimensions along a horizontal plane.

10. The system of claim 7, wherein the first edgelit lightguide comprises a first edge, wherein the second edgelit lightguide comprises a second edge, and wherein the system further comprises:

one or more first light emitting diodes mounted adjacent the first edge and oriented to couple light into the first edgelit lightguide via the first edge; and one or more second light emitting diodes mounted adjacent the second edge and oriented to couple light into the second edgelit lightguide via the second edge.

11. The system of claim 7, wherein the emergency signage comprises an inscription on a first face of the first edgelit lightguide.

* * * * *